US005294959A

United States Patent [19]

Nagao et al.

[11] Patent Number: 5,294,959

[45] Date of Patent: Mar. 15, 1994

[54] IMAGE FORMING APPARATUS WITH IMAGE DENSITY DETECTION MEANS FOR CONTROLLING IMAGE FORMING CONDITIONS

[75] Inventors: Yoshinori Nagao, Yokohama; Hisashi Fukushima, Kawasaki; Masami Izumizaki, Yokohama; Nobuatsu Sasanuma, Yamato, all of Japan

[73] Assignee: Canon Kabushiki Kaisha, Tokyo, Japan

[21] Appl. No.: 953,836

[22] Filed: Sep. 30, 1992

[30] Foreign Application Priority Data

Oct. 3, 1991 [JP] Japan ..... 3-283568
Oct. 24, 1991 [JP] Japan ..... 3-305427

[51] Int. Cl.[5] ..... G03G 15/00; G03G 15/16

[52] U.S. Cl. ..... 355/208; 355/271

[58] Field of Search ..... 355/208, 214, 246, 271, 355/274, 228; 346/160, 160.1; 358/300

[56] References Cited

U.S. PATENT DOCUMENTS 4,277,162 7/1981 Kasahara et al. ..... 355/14 R
4,709,250 11/1987 Takeuchi ..... 346/160
5,155,529 10/1992 Rushing ..... 355/208

FOREIGN PATENT DOCUMENTS 63-43169 2/1988 Japan .

*Primary Examiner*—Joan H. Pendegrass
*Attorney, Agent, or Firm*—Fitzpatrick, Cella, Harper & Scinto

[57] ABSTRACT

An image forming apparatus includes an image forming means, for forming an image on an image receiver member, which in turn includes an image bearing member on which a toner image can be born, a latent image forming means for forming a latent image modulated by an electric signal on the image bearing member, and transfer means for transferring the toner image onto the image receiver sheet. Also included in the image forming apparatus are first detection means for detecting the density of the toner image on the image bearing member before an image transferring operation, second detection means for detecting the density of the toner image on the image receiver member after the image transferring operation, and control means for controlling a transferring condition of the transfer means and an image forming condition of the latent image forming means on the basis of detection results from the first and second detection means.

39 Claims, 11 Drawing Sheets

IMAGE FORMING APPARATUS WITH IMAGE DENSITY DETECTION MEANS FOR CONTROLLING IMAGE FORMING CONDITIONS

BACKGROUND OF THE INVENTION

Field of the Invention

The present invention relates to an image forming apparatus such as an electrophotographic apparatus or an electrostatic recording apparatus embodied as a copying machine, printer or the like, and more particularly, it relates to an image forming apparatus having a detection means for detecting the density of an image.

Related Background Art

Generally, image forming apparatuses are designed so that an image developed on an image bearing member such as a photosensitive member is transferred onto an image receiver sheet by a transfer means. For example, the Japanese Patent Laid-open No. 63-43169 discloses the technique in which test patch images are formed on an image bearing member and are then transferred onto an image receiver sheet, and the image density of each test patch image is detected and a transfer current value is corrected on the basis of the detection result.

However, in the above-mentioned conventional technique, since the difference between two density values at predetermined line percentages (for example, 25%, 100%) which are not proportional to each other was determined as the transfer efficiency, it was impossible to consider the influence of the variation of the transfer efficiency due to the change in the environmental conditions and the influence of the variation of the image density due to the deterioration of the developing ability.

On the other hand, it is also known to form an image on a transfer sheet by transferring a toner image formed on an image bearing member onto the transfer sheet carried on a bearing film acting as a transfer sheet bearing member provided on a transfer drum of a transfer device. In the past, since there was no provision of any means for detecting any cracks and/or unevenness on the bearing film and the toner contamination of the bearing film, the bearing film was replaced by a new one when an operator judged the deterioration of the bearing film on the basis of the quality of the image outputted from the image forming apparatus or whenever a predetermined number of sheets designated by the maker was copied.

Further, in the, electrophotographic apparatus, structural elements thereof such as a charger may be smudged and deteriorated over a long time, with the result that the developing ability is worsened, thereby changing the density of the outputted image. On the other hand, for a short time, as mentioned above, the developing ability was varied due to the change in the environmental conditions such as the change in temperature and/or humidity, thereby also changing the density of the outputted image. Generally, such change in the image density was checked by the operator visually, and the density of the image was corrected by the operator manually via a density correction means.

However, if the user calls for a service man to repair the image forming apparatus even after the deterioration of the image quality occurs due to the toner contamination of the bearing film, the user's work will be delayed. Further, if the operator continues to operate the image forming apparatus without being aware of the contamination of the bearing film, the structural elements of the image forming apparatus which are contacted with the bearing film will be smudged with toner, with the result that an additional cleaning operation is required during the maintenance of the apparatus. Incidentally, the change in the image density is serious or critical for full-color copying machines or full-color printers wherein the color gradation is important. If the color gradation is varied due to a change in the density, the color tone of the outputted image will be different from the correct or normal one.

SUMMARY OF THE INVENTION

An object of the present invention is to provide an image forming apparatus which can form a good image regardless of a change in environmental conditions.

Another object of the present invention is to provide an image forming apparatus which can be used without delaying the user's work by causing a service man to replace a smudged bearing film (image receiver sheet, bearing member) with a new one, to replace structural elements which are contacted with the smudged bearing film with new ones, or to clean such structural elements, by detecting the toner contamination of the bearing film or of such structural elements in time.

A further object of the present invention is to provide an image forming apparatus which can obtain an image having excellent density and gradation by correcting the density of an image to be formed on an image receiver sheet on the basis of the measurement result of the density of a particular pattern image formed on the image receiver sheet.

A still further object of the present invention is to provide an image forming apparatus which can detect the toner contamination of an image receiver sheet bearing member in time and at the same time correct the density of a toner image to be formed on an image receiver sheet.

A further object of the present invention is to provide an image forming apparatus which can control an image forming condition for an image receiver sheet by determining the correct transfer efficiency.

Other objects and features of the present invention will be apparent from the following detailed explanation of the present invention.

DETAILED DESCRIPTION OF THE PREFERRED EMBODIMENTS

Figure 1:
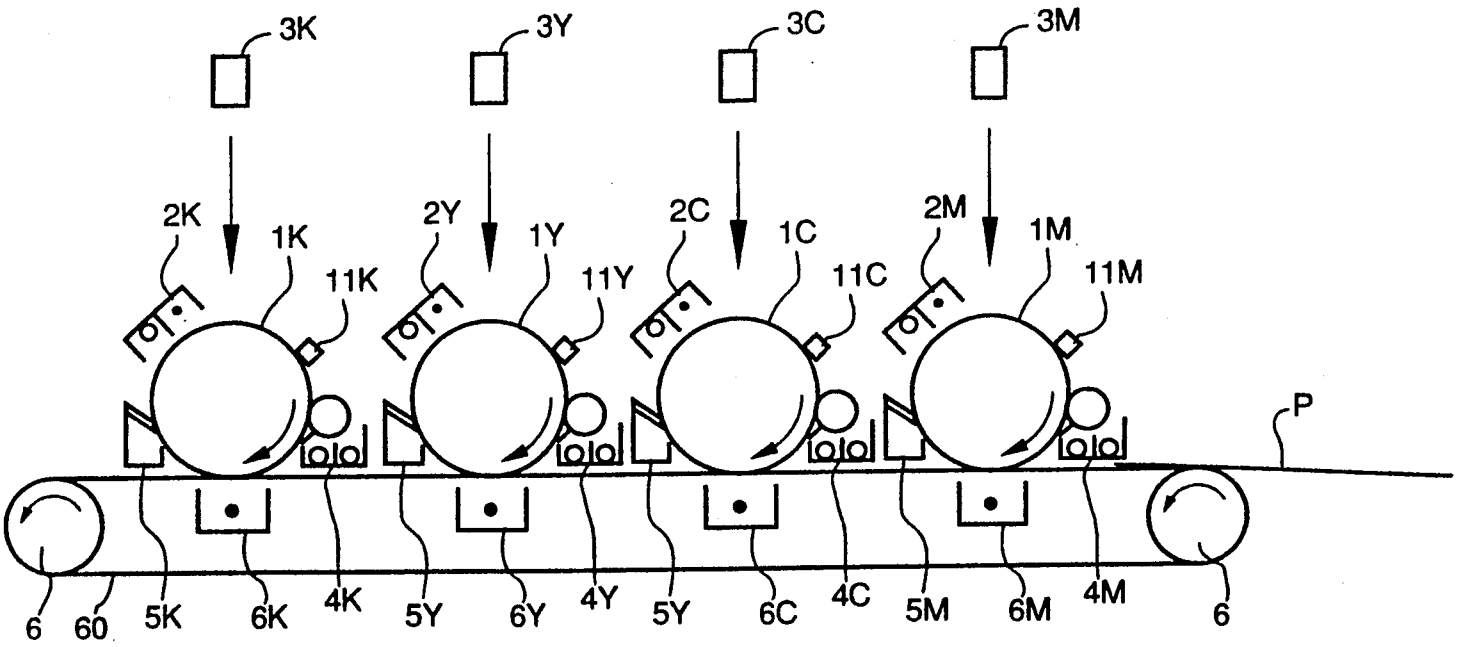
FIG. 1 is a schematic elevational sectional view of an image forming apparatus to which the present invention can be applied.

FIG. 1 is an example of an image forming apparatus to which the present invention can be applied. This image forming apparatus is embodied as a laser beam printer having optical scanning means utilizing a plurality of laser beams and also having four photosensitive drums (image bearing members) 1K, 1Y, 1C, 1M. The laser beam printer is designed so that it includes four developing means 4K, 4Y, 4C, 4M arranged around the corresponding photosensitive drums 1K, 1Y, 1C, 1M, respectively, each containing toner of different color, and toner images formed on the photosensitive drums 1K, 1Y, 1C, 1M by the respective developing means 4K, 4Y, 4C, 4M are transferred onto a transfer sheet P carried on a transfer sheet bearing member or belt 6*a* moving in a confronting relation to the photosensitive drums 1K, 1Y, 1C, 1M.

Further, first chargers 2K, 2Y, 2C, 2M are disposed around the respective photosensitive drums 1K, 1Y, 1C, 1M and optical scanning devices (optical scanning means) 3K, 3Y, 3C, 3M are also provided. Further, the above-mentioned developing means (devices) 4K, 4Y, 4C, 4M and cleaners 5K, 5Y, 5C, 5M are also provided.

Furthermore, a transfer station 6 forming a part of an image forming means includes a transfer belt 6*a* associated with the photosensitive drums 1K, 1Y, 1C, 1M in common, and transfer chargers (transfer means) 6K, 6Y, 6C, 6M associated with the respective photosensitive drums 1K, 1Y, 1C, 1M. The formation of a full-color image is achieved by successively transferring toner images having, different colors and formed on the respective photosensitive drums onto a transfer sheet P such as a paper sheet carried on the transfer belt 6*a*. Incidentally, the transfer sheet P is supplied from a sheet supply cassette (not shown). After the transferring operation, the transfer sheet P is separated from the transfer belt and then is sent to a thermal fixing device (not shown) where the full-color image is fixed to the transfer sheet. Thereafter, the transfer sheet is ejected out of the image forming apparatus.

Each of the optical scanning devices 3K, 3Y, 3C, 3M comprises a laser light source (not shown), a rotatable polygonal mirror for scanning a laser beam emitted from the laser light source, an $f\theta$ lens for gathering or condensing the scanned laser beam onto the generatrix on a surface of the photosensitive drum, a reflection mirror for deflecting a bundle of light, and a beam detection device for detecting the specific position of the scanned beam.

Figure 2:
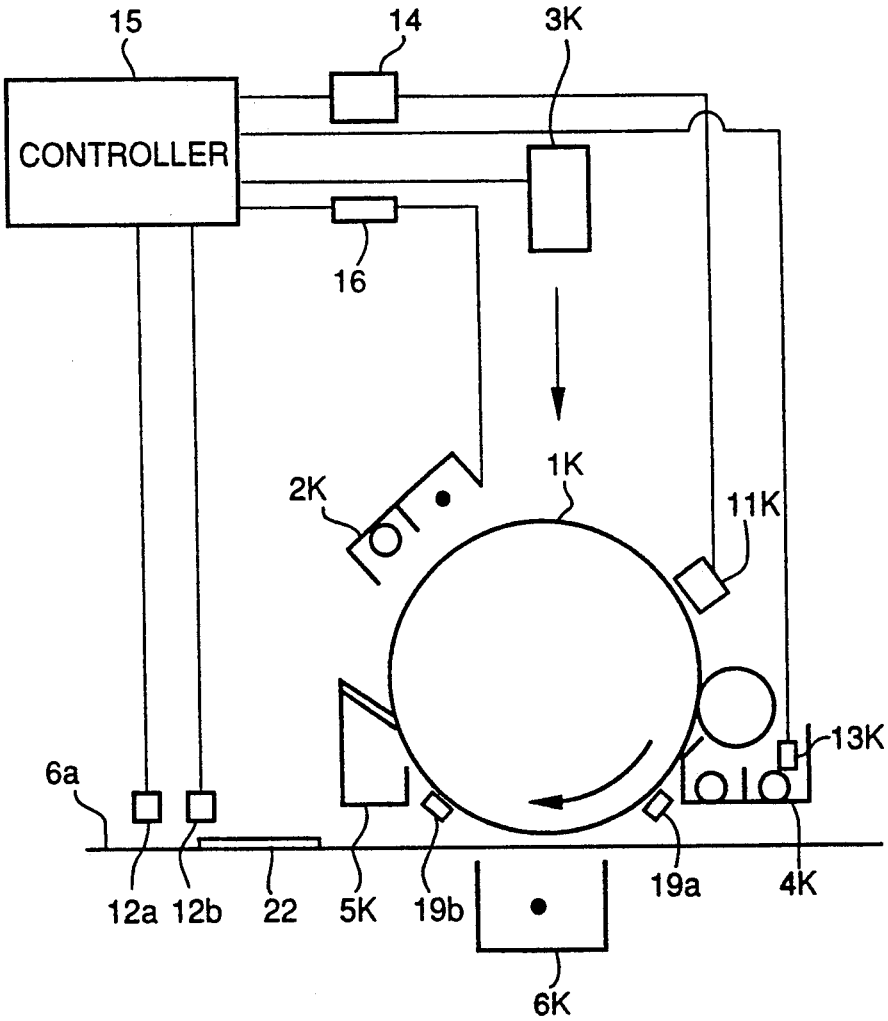
FIG. 2 is an enlarged view of a portion of FIG. 1.

FIG. 2 is an enlarged view of one of the image forming stations around the photosensitive drums, i.e., a final image forming station or a black image forming station as an example. A surface potential sensor 11K serves to detect a surface condition of the photosensitive drum 1K as a surface potential of that drum. The data detected by the surface potential sensor 11K is sent to a controller (control means) 15 via a potentiometer 14. A developer density sensor 13K which may be of reflection type or inductance type senses the density of the developer (toner) in the developing device 4K, so that the developer is replenished in the developing device on the basis of a signal from the developer density sensor 13K to keep the density of the developer in the developing device constant. Alternatively, in order to detect the density of the developer, a specific density image may be formed on the photosensitive drum 1K and the density of such image may be detected by light receiving elements 19*a* or 19*b*. In the illustrated embodiment, the latter method is used. The information from the developer density sensor 13K or the light receiving element 19*a*, 19*b* is also sent to the controller 15.

The reference numeral 22 denotes a test patch comprising a visualized developer image transferred to the transfer belt 6*a*. An LED 12*a* serves to emit light onto the test patch 22 and a light receiving element 12*b* receives light reflected from the test patch. The information from the light receiving element 12*b* is sent to the controller 15 where it is converted into density data. The image(s) to be transferred onto the transfer belt 6*a* may be test patches having 8-stepped or 16-stepped density gradation from the minimum density to the maximum density or may be test patchs having the same specific density. These test patches are generated by a test pattern generator (not shown).

Next, a method for measuring the transfer efficiency in accordance with the present invention will be explained with reference to FIG. 2. The test patches are generated by the test pattern generator, a latent image is formed on the photosensitive drum 1K by the laser beam from the optical scanning device 3K, and the latent image is visualized by the developing device 4K. The visualized image is read by the light receiving element 19*a*, and the read result is converted into density data by the controller 15 and is stored in the controller as density D1.

Thereafter, the visualized image is transferred onto the transfer belt 6*a* as a test patch 22 by the transfer charger 6K. The test patch is again read by the LED 12*a* and the light receiving element 12*b* disposed above the transfer belt 6*a*. The read result is converted into density data by the controller 15 and is stored in the controller as density D2. Further, the controller 15 compares the density D1 and the density D2 to determine the transfer efficiency D2/D1.

Figure 3:
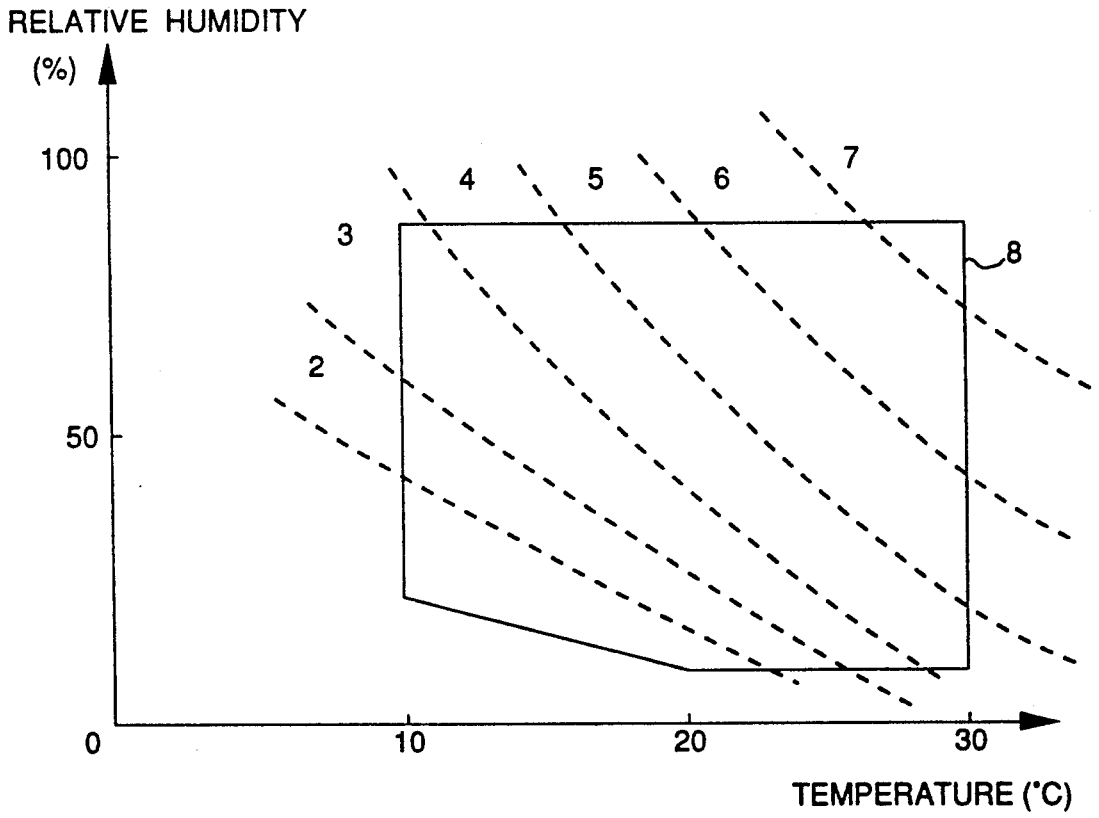
FIG. 3 is a table or graph showing transfer efficiency areas used with the image forming apparatus of FIG. 1.

Next, a correction means for correcting the transfer efficiency determined as mentioned above will be explained. FIG. 3 shows areas where the same transfer efficiency can be obtained by the same transfer current in connection with the change in temperature and relative humidity at a location where the image forming apparatus is installed. Zones 1-7 divided by the broken lines are such areas where the same transfer efficiency can be obtained by the same transfer current, and a compartment 8 defines an area where the transfer efficiency providing good image quality can be obtained. The temperature and the relative humidity are detected by environment sensors attached to the image forming apparatus.

Figure 4A:
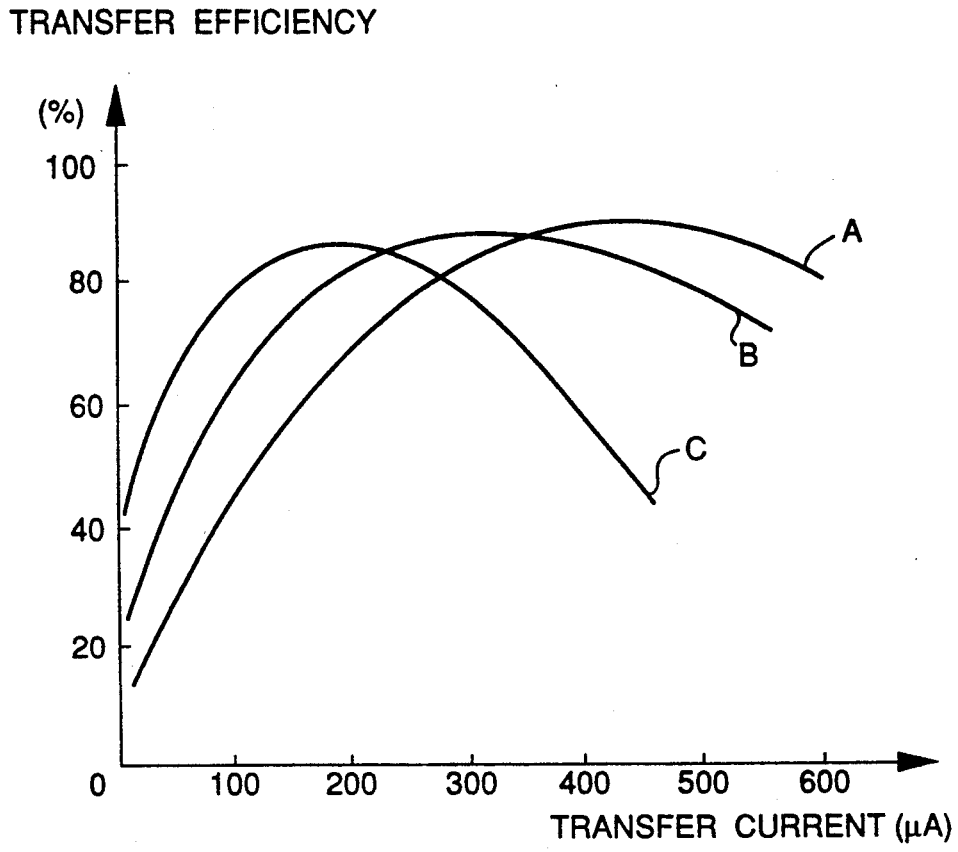
FIG. 4A is a graph showing the difference in transfer efficiency as a function of the difference in an environmental condition, for the apparatus of FIG. 1.

FIG. 4A shows a relation between the transfer current and the transfer efficiency in each of the environmental zones 1–7. The zone 2 corresponds to the solid line A, zone 4 corresponds to the solid line B and zone 7 corresponds to the solid line C. The relation between the transfer current and the transfer efficiency in zones 6, 5, 3, 1 are included between the lines A–C. For example, when the transfer efficiency of the transfer charger 6K is 75% (with a transfer current of 300 μA) and the environmental condition in this case is within zone 2, the transfer current, is corrected (increased) according to a table in the controller 15. On the other hand, when the transfer efficiency is 75% (with a transfer current of 300 μA) and the environmental condition in this case is within zone 7, the transfer current is corrected (decreased) according to the table in the controller 15. In this way, it is possible to determine the direction of the correction for the transfer efficiency reasonably in consideration of the environmental condition.

Figure 4B:
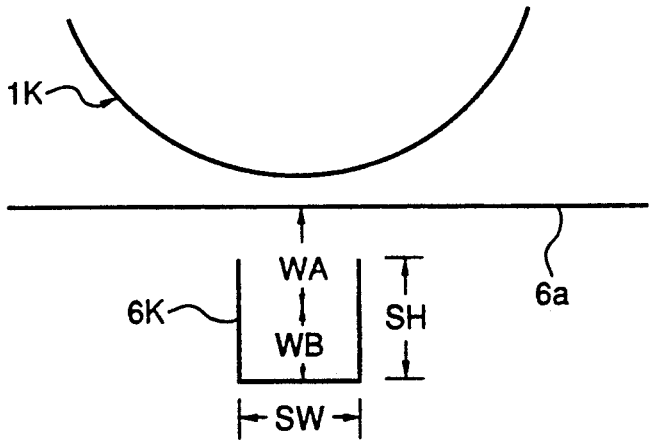
FIG. 4B is a view showing a relation between a photosensitive drum and a transfer charger, according to the apparatus of FIG. 1.

FIG. 4B shows the specification of the transfer station used in the test. The toner (developer) has a particle diameter of 8 μm and a charging amount of −30 μc/g, and the photosensitive drum has an OPC photosensitive body of 80% and includes a CT layer having a thickness of 20 μm and a dielectric constant (ε) of 2.7. The transfer belt 6*a* has a volume resistivity of $10^{14}$–$10^{15}$ Ω.cm and a film thickness of 150 μm. A shield width SW and a shield height SH of the transfer charger are both 20 mm. A distance WH between a wire and the transfer belt is 10 mm, and a distance WB between the wire and an inner surface of the shield is 15 mm. The wire is made of tungsten and has a diameter of 60 μm.

Since the relation between the transfer current and the transfer efficiency is varied in accordance with a change in the above-mentioned environmental condition (the property shown in FIG. 3 is only an example), the transfer current may be determined on the basis of the specification of each image forming apparatus. It is possible to always provide a stable image by utilizing the optimum transfer current determined as mentioned above.

In the illustrated embodiment, while the test patches were formed on the transfer belt 6*a*, they may be formed on the transfer sheet P carried on the transfer belt 6*a*.

When the test patches are formed on the transfer sheet P, six test patches are formed by changing the total current values supplied to the transfer chargers 6M–6K by 100 μA for example from 100 μm to 600 μA and such test patches are read by the light receiving element 12*b*, and the read data is sent to the controller 15 to be converted into density data. Such data is plotted on a graph in the memory of the controller 15, so that the optimum transfer current can be determined from a peak value of the transfer efficiency.

FIG. 4A shows an example of such a graph in the memory of the controller 15. The line C defines the relation between the transfer efficiency and the transfer current when the temperature is 30° C. and the relative humidity is 80%, the line B defines such relation when the temperature is 23° C. and the relative humidity is 60%, and the line A defines such relation when the temperature is 20° C. and the relative humidity is 10%. According to the test for seeking a relation between the total current values applied to the transfer chargers and the transfer efficiency, it was found that, although the transfer efficiency was varied with the environmental condition, in the illustrated embodiment, it was possible to determine the optimum transfer current regarding all environmental conditions by varying the transfer current within a range of 100–60 μA.

Further, as shown in FIG. 2, in place of the sensor 19*a* for reading the test patch images on the photosensitive drum, a light receiving element 19*b* may be provided. In this case, the arrangement of the sensor 19*b* at a downstream side in a rotating direction of the photosensitive drum is more advantageous in comparison with the arrangement of the sensor 19*a* at an upstream side in the rotating direction of the photosensitive drum because the sensor 19*b* will be less smudged than the sensor 19*a* by toner scattered from the developing device. However, when the test patch image is detected by the light receiving element 19*b*, such test patch image is not yet transferred to the transfer belt 6*a* or the transfer sheet P. Accordingly, in this case, after the detection of the test patch image, this test patch image on the photosensitive drum is not erased or cleaned by a cleaning blade (by separating the blade from the surface of the photosensitive drum) and is transferred onto the transfer belt or the transfer sheet when such test patch image reaches the transfer station again. The test patch image transferred to the transfer belt 6*a* or the transfer sheet P is detected by the sensors 12*a*, 12*b*, thereby seeking the transfer efficiency. In order to seek transfer efficiency, although the test patch images may be detected before and after the transferring operation, respectively, since the residual toner image after the transferring operation is extremely thin in comparison with the actually transferred toner image, it is not preferable to detect the residual toner image because the detection accuracy is lower due to the unevenness of toner on the residual toner image.

Incidentally, in the illustrated embodiment, the sensors for reading the test patches on the transfer belt 6*a* may also act or serve to detect any discrepancy in registration.

Figure 5:
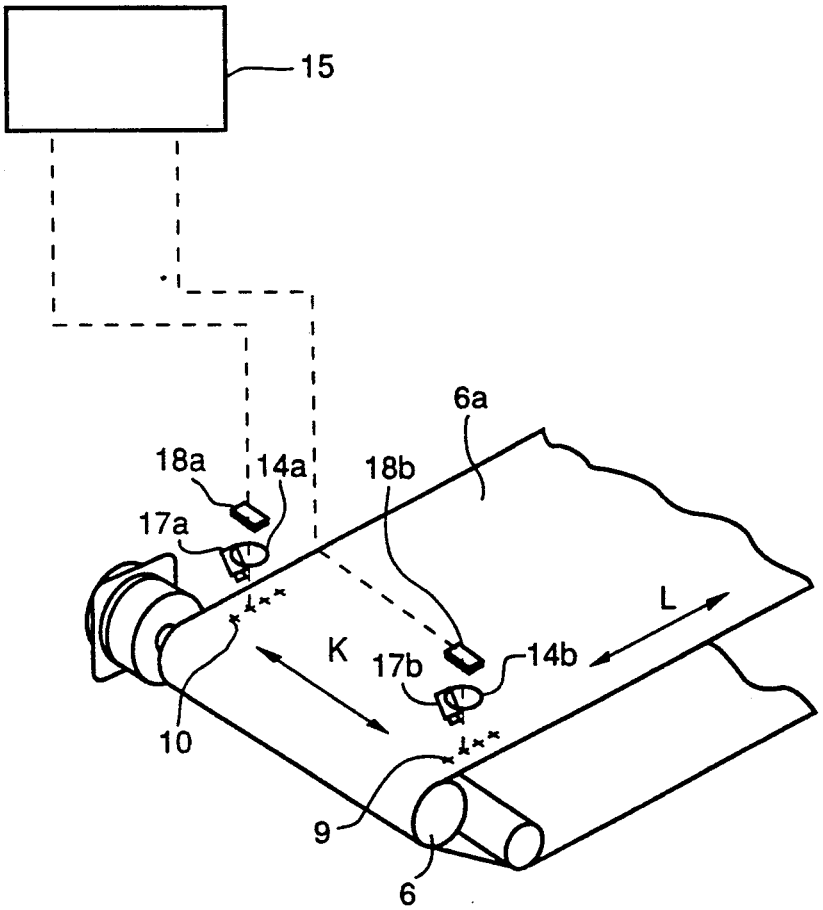
FIG. 5 is a perspective view showing a registration servo portion.

FIG. 5 is a perspective view of a portion of the transfer belt 6*a*. In FIG. 5, the reference numerals 9 and 10 denote registration patterns each having a criss-cross or # shape and having a different color formed on the transfer belt 6*a*; 18*a*, 18*b* denote reading elements capable of reading the patterns 9, 10; 17*a*, 17*b* denote light sources; and 14*a*, 14*b* denote optical systems.

In this embodiment, in the system for reading the test patterns in the aforementioned embodiment, the registration patterns having different colors are read by the sensors 18*a*, 18*b*, thereby detecting any discrepancy in the colors along a main scanning direction K and a sub scanning direction L. Thus, by controlling optical scanning systems (not shown), it is also possible to improve the accuracy of the registration. Incidentally, the patterns 9, 10 may be formed on the transfer sheet P.

Further, in FIG. 5, the light receiving elements (pattern detection means) 18*a*, 18*b* are arranged along the main scanning direction K in the same transversal line. In the illustrated embodiment, the density of the test patch detected by one of the light receiving elements and the density of the test patch detected by the other light receiving element are averaged by the controller 15, thereby improving the reading accuracy.

In order to ensure that the test patches or the registration patterns 9, 10 are not influenced by any cracks or unevenness in the transfer belt 6*a*, it is preferable that each patch or pattern be transferred onto the transfer belt 6*a* at the same position or location thereon. For example, if the black toner includes carbon black, since the carbon black absorbs wavelengths in the sensitive areas of the light receiving elements 19*a*, 19*b*, 12*a*, 12*b*, 18*a*, 18*b*, it is feared that the reading of the test patches or registration patterns cannot be effected. Accordingly, when toner having the above property is used in combination with other readable toner, completely solid patches with the readable toner have previously been transferred onto the transfer belt 6*a*, and test patches with the non-readable toner are transferred on the transfer belt by superimposing them on the previously transferred readable test patches. In this way, the absorbing property is read by each light receiving element, with the result that all of the toner density can be read. In this case, however, a further table for converting the read result into the density data must be added to the controller 15.

It is desirable that the control of the correction of the transfer current on the basis of the test patches is effected after a predetermined operation such as an ON/-OFF operation of a main power source, the activation of a reset switch due to a sheet jam, or an opening/closing operation of a front door.

Further, it is preferable that specific environmental conditions, i.e., the temperature and humidity in the atmosphere at the location where the image forming system is installed are detected by the detection means attached to the system, and control is effected on the basis of the detection result.

In the case of an image forming apparatus capable of forming a color image, when magenta test patch images are formed at the first station, it is geared such that the test patches are contacted with the photosensitive drums 1Y, 1C, 1K for yellow, cyan and black colors, thereby deteriorating the magenta toner images. In this case, when the test patches formed at an upstream image forming station pass through a downstream image forming station, it is desirable to separate the transfer belt 6*a* from the photosensitive drum, for example, by lowering the transfer belt 6*a* or by releasing an urging member (not shown) for urging the photosensitive drum against the transfer belt 6*a*.

In the illustrated embodiment, while both the temperature and the humidity were detected, either temperature or humidity may be detected.

Figure 6:
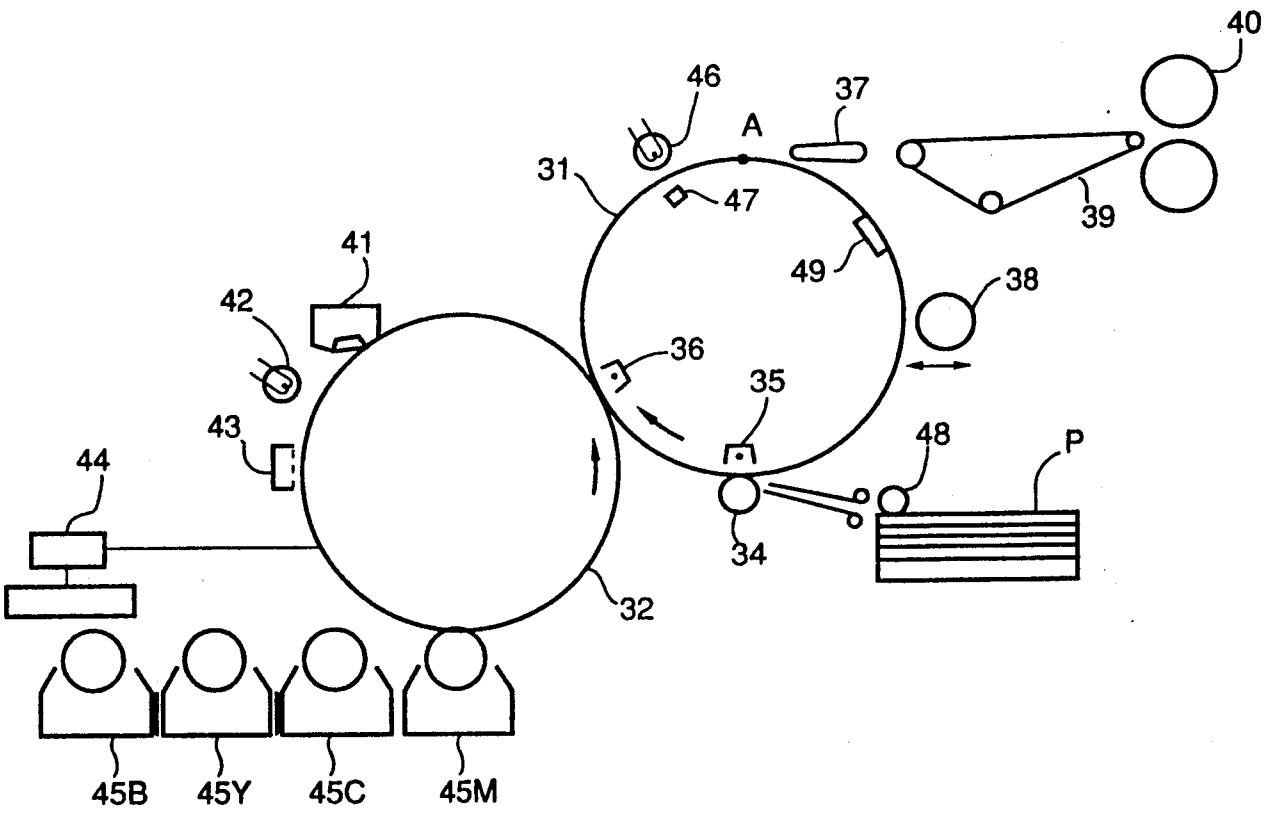
FIG. 6 is a schematic elevational sectional view of an image forming apparatus according to an embodiment of the present invention.

Next, an image forming system (digital full-color printer) having a detection means for detecting the fault of a transfer sheet bearing member will be explained with reference to FIG. 6.

The image forming apparatus (digital full-color printer) comprises a photosensitive drum 32 as an image bearing member. In order to form an image, first of all, the residual toner remaining on the photosensitive drum 32 is removed by a cleaner 41, the surface potential on the photosensitive drum 32 is erased by a pre-exposure device 42 and the surface of the photosensitive drum 32 is uniformly charged by a primary charger 43. Then, a latent image is formed on the photosensitive drum 32 by scan-exposing the surface of the photosensitive drum 32 in a digital manner by illuminating a laser beam (a pulse width of which is modulated in response to image data) onto the photosensitive drum via a polygonal mirror 44. The latent image is developed by one of developing devices 45M, 45C, 45Y, 45B for magenta, cyan, yellow and black colors, respectively, in response to an image signal to visualize the latent image as a toner image.

On the other hand, a transfer sheet P such as a paper sheet is supplied from a sheet supply cassette by a sheet supply roller 48 and is sent to a transfer drum 31 having a transfer sheet bearing film made of PVdF (polyvinylidene fluoride). The transfer sheet P sent to the transfer drum 31 is securely adhered to and carried by the transfer sheet bearing film of the transfer drum 31 by an adsorption roller 34 disposed outside of the transfer drum and an adsorption charger roller 35 disposed inside of the transfer drum. The transfer sheet P carried on the transfer sheet bearing film is conveyed to an image transferring station in a confronting relation to the photosensitive drum 32 in response to the rotation of the photosensitive drum. While the transfer sheet passes through the image transferring station, the first toner image formed on the photosensitive drum 32 is transferred onto the transfer sheet by a transfer charger 36.

A second toner image is formed on the photosensitive drum 32 in the same manner as mentioned above, and the second toner image is transferred onto the same transfer sheet P on which the first toner image was transferred by the transfer charger 36, to superimpose the second toner image with the first toner image in registration with each other. Similarly, a third toner image and a fourth toner image are formed and are transferred onto the same transfer sheet P in the superimposed fashion, thereby obtaining a full-color image by combining four color toner images.

In the illustrated embodiment, while the magenta, cyan, yellow and black color toner images were formed and transferred in order, the order of the colors is not limited to the above.

The transfer sheet P on which the four color superimposed image were formed is separated from the transfer sheet bearing film by a separating claw 37 and then is sent, by a convey roller 39, to a fixing device 40, where the four color toner images are fused and mixed. Thereafter, the transfer sheet is ejected out of the printer as an output image.

When the image forming operation is completed, since the scattered toner is adhered to the parts within the printer, in order to remove such toner, a rotating fur brush 38 is urged against the transfer sheet bearing film to clean the latter.

According to the present invention, in order to detect a fault (such as toner contamination) of the transfer sheet bearing film, a fault detection means comprising a light source 46 for lighting the transfer sheet bearing film and an optical sensor 47 is provided. In the illustrated embodiment, at an upstream side of the separating claw 37, the light source 46 and the optical sensor 47 are disposed outside and inside of the transfer sheet bearing film, respectively, with the interposition of the latter. The light source 46 comprises an LED emitting infrared light and the optical sensor 47 comprises a photodiode. The light source 46 and the optical sensor 47 are arranged along a longitudinal length of the transfer drum 31 to cover an area of the transfer sheet bearing film which is contacted with the adsorption roller 34.

Figure 7:
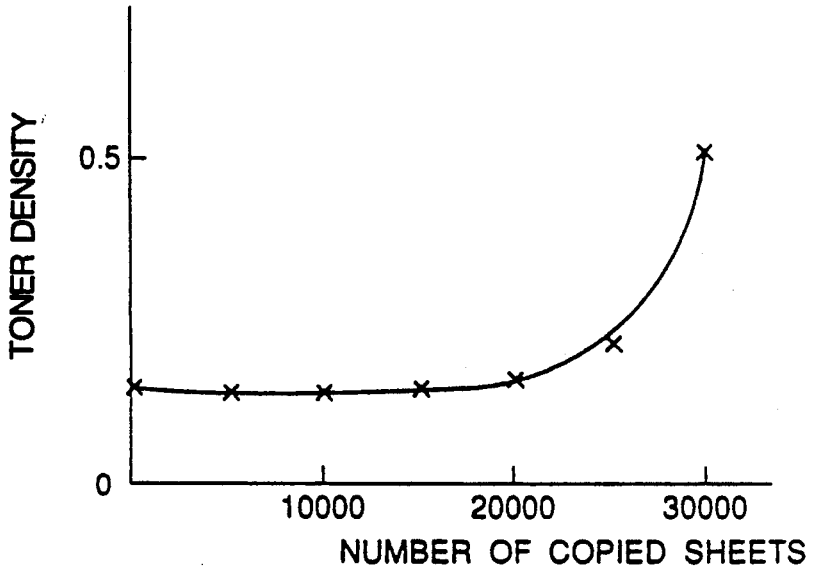
FIG. 7 is a graph showing a relation between the toner density and the number of copied sheets when the density of toner adhered to a transfer sheet bearing film is detected by a toner density detection means provided in the image forming apparatus of FIG. 6.

FIG. 7 shows a relation between the toner density and the number of copied sheets when the density of toner adhered to the transfer sheet bearing film at a position A ahead of a supporting member 49 for the transfer drum 31 by 10 cm in the upstream direction of the rotation of the transfer drum is detected by the light source 46 and the optical sensor 47 on the basis of the amount of light passing through the film.

The scattered toner or the toner not removed by the fur brush is apt to adhere and solidify to the area of the transfer sheet bearing film with which the adsorption roller 34 is contacted, and, when the number of copied sheets exceeds 20000, the solidification of toner on the transfer sheet bearing film is initiated, with the result that, when the number of copied sheets exceeds 30000, the toner density on the transfer sheet bearing film will increase up to about 0.5.

The image quality of the outputted image causes a transfer void when the toner starts to adhere to the transfer sheet bearing film to reduce the transfer efficiency. Further, an cracks or recesses are formed in the transfer sheet bearing film, the toner is apt to stick to such cracked or recessed portions. Thus, in the illustrated embodiment, when the toner density on the transfer sheet bearing film becomes 0.25 or more, it is assumed that the transfer sheet bearing film is smudged sufficiently to become wrong or faulty, so that a message for a fault of the transfer sheet bearing film is displayed on an appropriate display means or on the existing display means provided on an operation panel of the printer.

Figure 8:
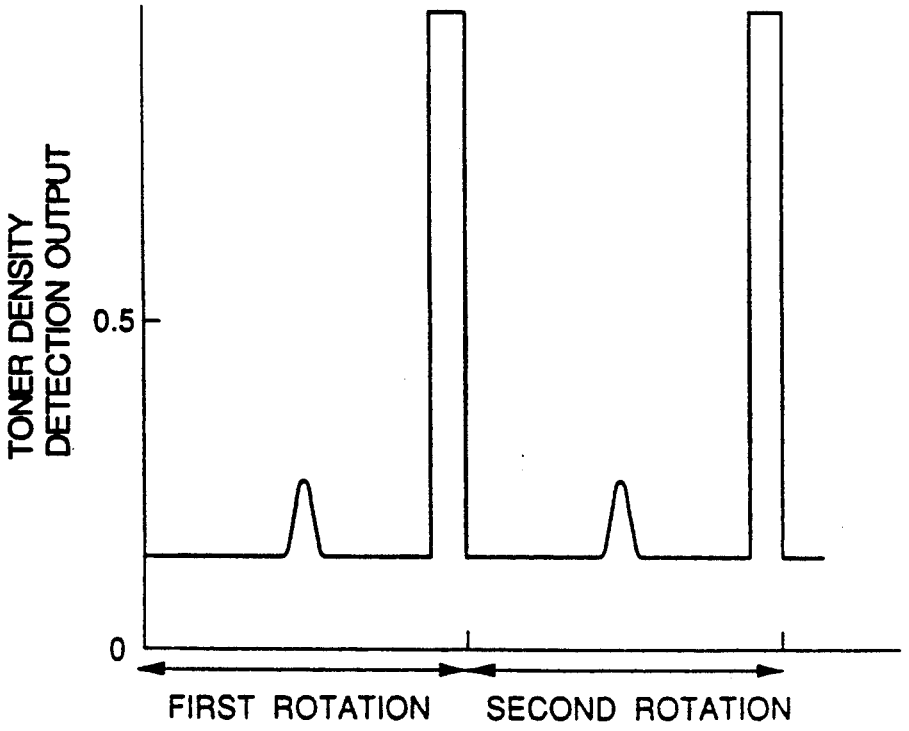
FIG. 8 is a graph showing the change in the toner density detection output when the density of toner adhered to a transfer sheet during the rotation of a transfer drum is detected by the toner density detection means.

As apparent from FIG. 8 showing an example of the change in the toner density detection output when the toner density on the transfer sheet bearing film is detected while the transfer drum 31 is being rotated, while the transfer drum 31 is rotated by one revolution, the toner density has two peaks, a larger one of which is caused by blocking the light from the light source 46 by the supporting member 49 for supporting the transfer sheet bearing film of the transfer drum 31, a smaller peak being caused by the partial toner contamination of the transfer sheet bearing film. Accordingly, concretely, except for the increase in the toner density caused by blocking the light by the supporting member 49, when the toner density exceeds 2.5, the message for the fault of the transfer sheet bearing film may be displayed.

In the illustrated embodiment, the timing for exchanging the transfer sheet bearing film smudged by the toner and cleaning or exchanging parts of the image forming system (such as the adsorption roller 34) which are contacted with the transfer sheet bearing film can be known in time, and such exchanging or the cleaning can be effected accordingly.

While the toner contamination of the transfer sheet bearing film is detected by measuring the amount of light (from the light source 46 of the fault detection means) passing through the transfer sheet bearing film by means of the optical sensor 47, cracks on the transfer sheet bearing film can also be detected by measuring the light amount passing through the transfer sheet bearing film by the optical sensor 47.

Figure 9:
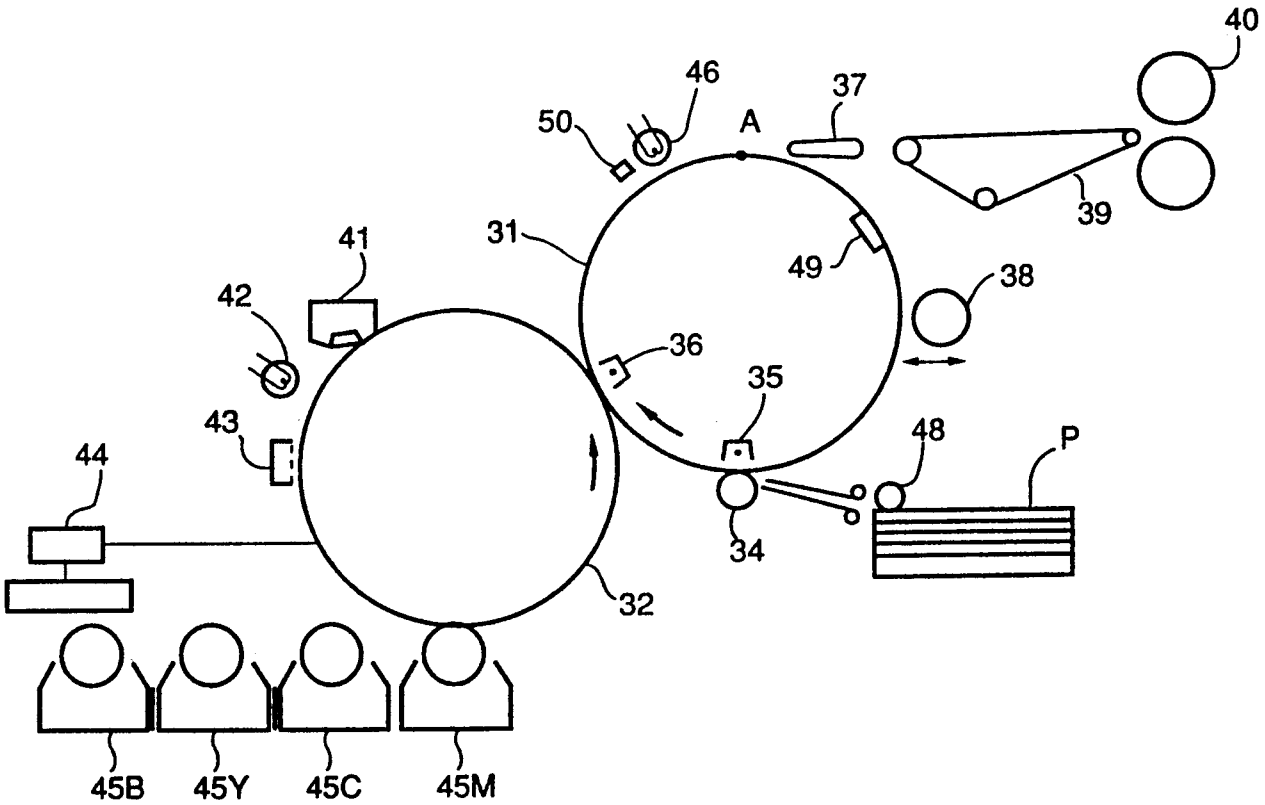
FIG. 9 is a schematic elevational sectional view of an image forming apparatus according to another embodiment of the present invention.

FIG. 9 is a schematic elevational sectional view of an image forming system according to another embodiment of the present invention. In this embodiment, the image forming apparatus is embodied as a full-color printer of digital type which can express the gradation in an area modulation manner by modulating the pulse width of the image density.

In this embodiment, the image forming apparatus comprises an optical sensor 50 arranged adjacent to a light source 46 disposed outside of the transfer drum 31 at an upstream side of the separating claw 37 so as to measure the density of a toner image transferred to the transfer sheet P carried on the transfer sheet bearing film of the transfer drum on the basis of an amount of the reflected light. Incidentally, the light source 46 and the optical sensor 50 constitute a density detection means.

Figure 10:
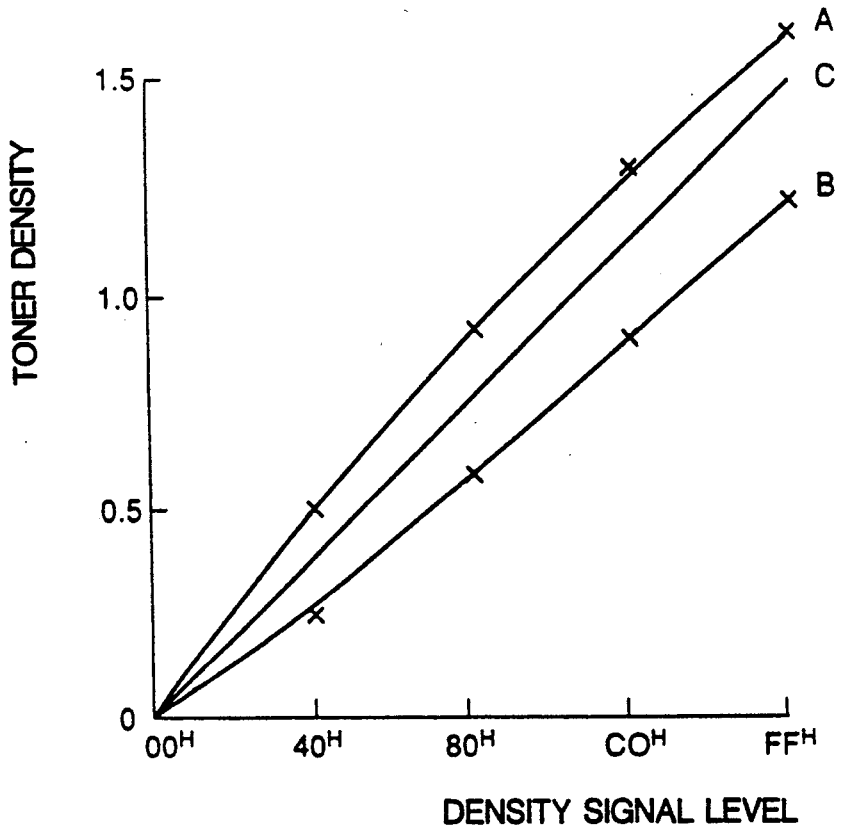
FIG. 10 is a graph showing a relation between the set toner density and the density signal level and also showing the toner density of a patch image detected by a toner density detection means provided in the image forming apparatus of FIG. 9.

Further, the image forming system incorporates therein a test pattern generator (not shown) so that patch toner images having plural density levels can be outputted by previously setting a relation between the image density signal level and the toner density as shown by the line C in FIG. 10.

Figure 11:
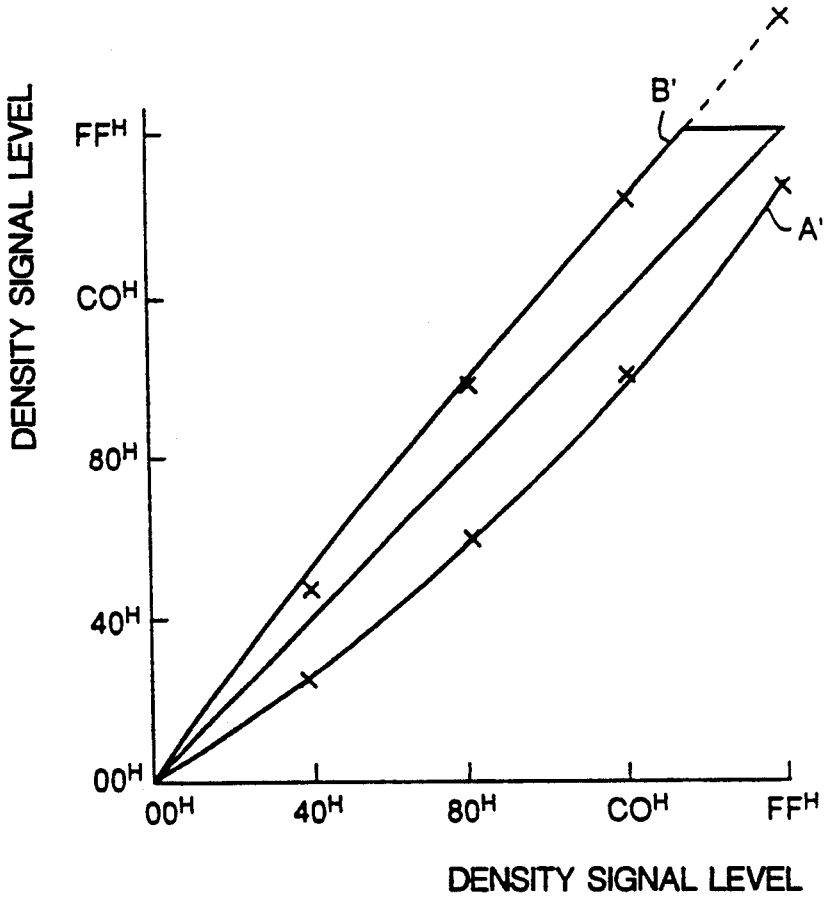
FIG. 11 is a graph showing the contents of a correction table used to correct the toner density by an LUT control on the basis of a detection result of the toner density of the patch image detected by the toner density detection means.

According to the illustrated embodiment, the density level signals are divided by 8-bit, i.e., into 256 gradations, the patch images are formed at locations where the toner density can be measured by the light source 46 and the optical sensor 50 regarding five levels 00H, 40H, 80H, COH, FFH, and then the density of the patch image is measured at the five density levels in registration with the passage of the transferred patch image under the optical sensor 50. If the measured density is higher than the set density (line C) as shown by the line A in FIG. 10, by a density correction means provided in the image forming apparatus (for example, a CPU in the image forming system), the difference between the set density and the actual density is calculated to obtain an LUT (look-up table) as shown by the line A' in FIG. 11, and the actual density is corrected to have the set gradation property shown by the line C in FIG. 10 by effecting gradation correction under the LUT control using the look-up table. On the other hand, if the measured density is lower than the set density as shown by the line B in FIG. 10, the difference between the set density and the actual density is calculated to obtain an LUT as shown by the line B' in FIG. 11, and the actual density is corrected to have the set gradation property shown by the line C in FIG. 10 by effecting gradation correction under the LUT control.

In the image forming apparatus according to this embodiment, since the density of the toner image to be formed on the transfer sheet can be corrected as mentioned above, it is possible to obtain plural color images having the proper density and gradation.

In the illustrated embodiment, while the density and the gradation were adjusted by density correction under the LUT control, the density correction may be effected by a contrast potential (difference between the potential of a dark portion and the potential of a bright portion) or a developing potential, or may be effected by a combination thereof. It is preferable that density correction is performed for each color.

Also, in electrophotographic copying machines of analogue exposure type, patch images consisting of patches having plural density levels may be placed on an original glass support to measure the density thereof by the optical sensor 50, and the light amount of the light source 46 and/or the developing bias may be adjusted on the basis of the difference between the original density and the measured density of the patch image to effect density correction controlling the density and the gradation of the image. Also in this case, it is possible to obtain plural color images having the proper density and gradation for each color.

Figure 12:
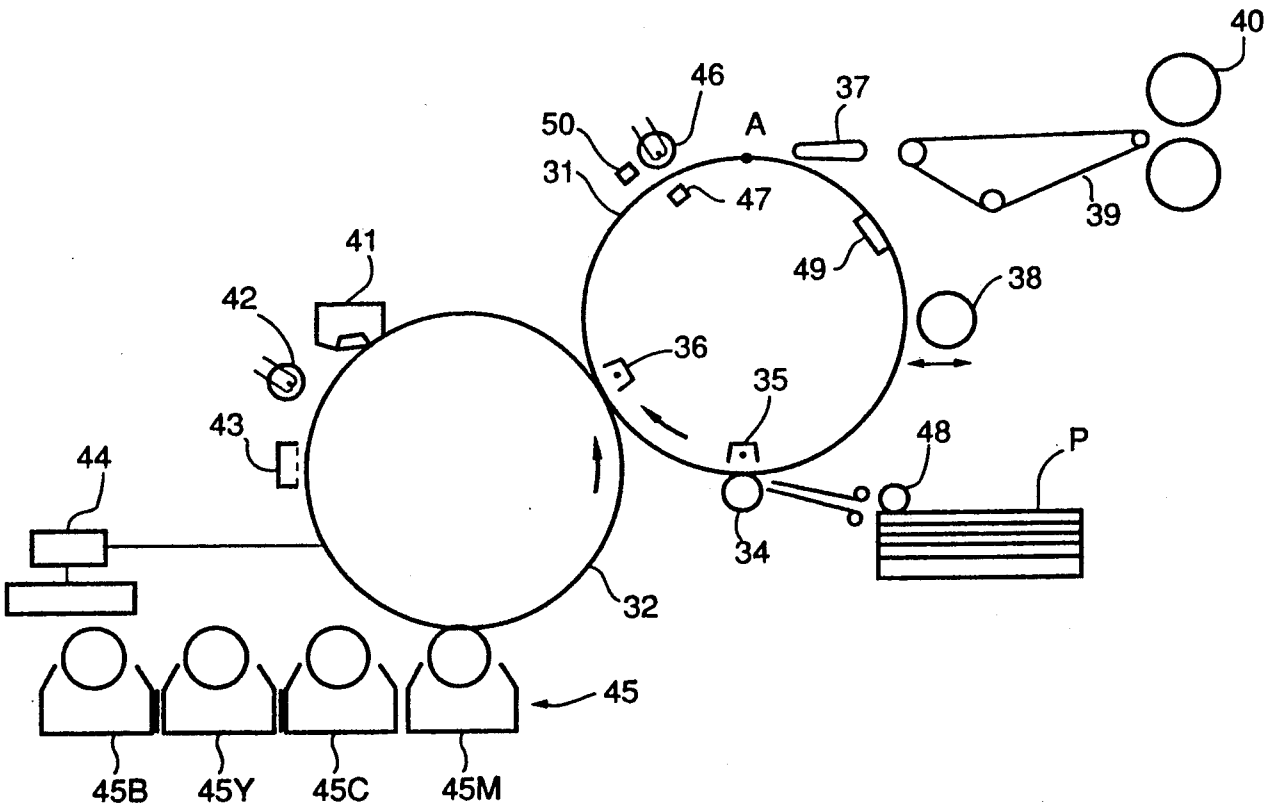
FIG. 12 is a schematic elevational sectional view of an image forming apparatus according to a further embodiment of the present invention.

FIG. 12 is a schematic elevational sectional view of an image forming apparatus according to a further embodiment of the present invention. In this embodiment, regarding the single light source 46 disposed outside of the transfer drum 31 at the upstream side of the separating claw 37, there are provided a first optical sensor 47 arranged inside of the transfer sheet bearing film and a second optical sensor 50 arranged outside of the transfer sheet bearing film.

When contamination of the transfer sheet bearing film is detected, an amount of light (from the light source 46) passing through the transfer sheet bearing film having no transfer sheet P thereon is measured by the first optical sensor 47, thereby detecting the density of the toner adhered to the transfer sheet bearing film. On the other hand, when density correction controlling the density and the gradation as the property of the printer is desired, an amount of light passing through the transfer sheet P on which the patch images were formed is measured by the second optical sensor 50, thereby detecting the density of the patch images at the five density levels.

Thus, also in this embodiment, the timing for exchanging the transfer sheet bearing film smudged by the toner and exchanging or cleaning parts of the image forming apparatus (such as the adsorption roller 34) which are contacted with the transfer sheet bearing film can be known in time, and such exchanging or the cleaning can be effected accordingly. In this way, it is possible to obtain plural color images having the proper density and gradation for each color. To this end, since only one light source 46 may be provided (not two light sources), cost increase can be avoided in this embodiment.

Incidentally, a fault (such as toner contamination) of the transfer sheet bearing member may, of course, be detected by the sensors 12*a*, 12*b* as shown in FIG. 2.

It should be noted that the present invention is not limited to the above-mentioned embodiments, but various alterations and modifications can be effected within the scope of the present invention.

What is claimed is:

1. An image forming apparatus, comprising:

image forming means for forming an image on an image receiver member, said image forming means including an image bearing member on which a toner image can be born, latent image forming means for forming a latent image on said image bearing member by modulating a signal in accordance with data of said image, and transfer means for transferring said toner image onto said image receiver member;

first detection means for detecting a density of said toner image on said image bearing member before an image transferring operation;

second detection means for detecting a density of said toner image on said image receiver member after an image transferring operation; and control means for controlling a transferring condition of said transfer means on the basis of detection results from said first and second detection means, and for controlling a latent image forming condition of said latent image forming means on the basis of detection results from said first and second detection means.

2. An image forming apparatus according to claim 1, wherein said image receiver member is a transfer sheet, and wherein said image forming apparatus further comprises a sheet bearing member for bearing said transfer sheet thereon.

3. An image forming apparatus according to claim 1, wherein said image receiver member is a sheet bearing member.

4. An image forming apparatus according to claim 1, wherein said second detection means detects a density of an unfixed toner image on said image receiver member.

5. An image forming apparatus according to claim 1, further comprising third detection means for detecting an environmental condition, wherein said control means controls the transferring condition of said transfer means on the basis of detection results from said first, second and third detection means.

6. An image forming apparatus according to claim 4, further comprising third detection means for detecting an environmental condition; and wherein said control means control the transferring condition of said transfer means on the basis of detection results from said first, second and third detection means.

7. An image forming apparatus according to claim 5, wherein the environmental condition includes at least one of temperature and humidity.

8. An image forming apparatus according to claim 6, wherein the environmental condition includes at least one of temperature and humidity.

9. An image forming apparatus according to claim 1, wherein said second detection means detects a position of the toner image on said image receiver member.

10. An image forming apparatus according to claim 4, wherein said transfer means transfers the toner image onto said image receiver member electrostatically, and said control means controls a transfer current on the basis of detection results from said first and second detection means.

11. An image forming apparatus according to claim 6, wherein said transfer means transfers the toner image onto said image receiver member electrostatically, and said control means controls a transfer current on the basis of detection results from said first, second and third detection means.

12. An image forming apparatus according to claim 3, wherein said second detection means can detect the fault of said sheet bearing member; and further comprising display means for displaying the fault on the basis of an output of said second detection means.

13. An image forming apparatus according to claim 12, wherein said second detection means detects an amount of light emitted from a light source and passing through said sheet bearing member.

14. An image forming apparatus according to claim 12, wherein said second detection means detects an amount of light emitted from a light source and reflected from said sheet bearing member.

15. An image forming apparatus according to claim 2, wherein plural color toner images can be formed on said image bearing member, said toner images being successively transferable onto said image receiver member in a superimposed fashion.

16. An image forming apparatus according to claim 3, wherein plural color toner images can be formed on said image bearing member, said toner images being successively transferable onto said image receiver member in a superimposed fashion.

17. An image forming apparatus according to claim 15, wherein a full-color image can be formed.

18. An image forming apparatus according to claim 16, wherein a full-color image can be formed.

19. An image forming apparatus according to claim 2, wherein said sheet bearing member is flexible.

20. An image forming apparatus according to claim 3, wherein said sheet bearing member is flexible.

21. An image forming apparatus comprising:

an image receiver sheet bearing member for carrying an image receiver sheet;

image forming means for forming an image on said image receiver sheet carried on said image receiver sheet bearing member;

detection means for detecting the fault of said image receiver sheet bearing member, said detection means being arranged in a confronting relation to said image receiver sheet bearing member and being adapted to detect the density of the image;

display means for displaying the fault on the basis of an output from said detection means; and control means for controlling an image forming condition of said image forming means on the basis of an output from said detection means.

22. An image forming apparatus according to claim 21, wherein said image forming means comprises an image bearing member on which a toner image can be born, and transfer means for transferring said toner image onto said image receiver sheet.

23. An image forming apparatus according to claim 21, wherein said second detection means detects an amount of light emitted from a light source and passing through said image receiver sheet bearing member.

24. An image forming apparatus according to claim 21, wherein said second detection means detects an amount of light emitted from a light source and reflected from said image receiver sheet bearing member.

25. An image forming apparatus according to claim 22, wherein plural color toner images can be formed on said image bearing member, and these toner images are successively transferred onto said image receiver sheet carried on said bearing member in a superimposed fashion.

26. An image forming apparatus according to claim 25, wherein a full-color image can be formed.

27. An image forming apparatus according to claim 21, wherein said image receiver sheet bearing member is flexible.

28. An image forming apparatus, comprising:

image forming means for forming an image on an image receiver member, said image forming means including an image bearing member on which a toner image can be born and transfer means for transferring said toner image onto said image receiver member;

first detection means for detecting a density of said toner image on said image bearing member before an image transferring operation;

second detection means for detecting a density of said toner image on said image receiver member after an image transferring operation;

third detection means for detecting an environmental condition; and control means for controlling an image forming condition of said image forming means on the basis of detection results from said first, second and third detection means.

29. An image forming apparatus according to claim 28, wherein said image receiver member is a transfer sheet, and wherein said image forming apparatus further comprises a sheet bearing member for bearing said transfer sheet thereon.

30. An image forming apparatus according to claim 28, wherein said image receiver member is a sheet bearing member.

31. An image forming apparatus according to claim 28, wherein the environmental condition includes one of temperature and humidity.

32. An image forming apparatus according to claim 28, wherein said second detection means detects a density of an unfixed toner image on said image receiver member.

33. An image forming apparatus according to claim 29, wherein plural color toner images can be formed on said image bearing member, and said toner images are successively transferred onto said image receiver member in superimposed fashion.

34. An image forming apparatus according to claim 33, wherein a full-color image can be formed.

35. An image forming apparatus, comprising:

image forming means for forming an image on an image receiver member, said image forming means including an image bearing member on which a toner image can be born and transfer means for transferring said toner image onto said image receiver member;

first detection means for detecting a density of said toner image on said image bearing member before an image transferring operation;

second detection means, for detecting a transfer position of said toner image on said image receiver member, and for detecting a density of said toner image on said image receiver member after an image transferring operation; and control means for controlling an image forming condition of said image forming means on the basis of detection results from said first and second detection means.

36. An image forming apparatus according to claim 35, wherein said image receiver member is a transfer sheet, and wherein said image forming apparatus further comprises a sheet bearing member for bearing said transfer sheet thereon.

37. An image forming apparatus according to claim 35, wherein said control means controls an output of said transfer means on the basis of detection results from said first and second detection means.

38. An image forming apparatus according to claim 36, wherein plural color toner images can be formed on said image bearing member, and said toner images are successively transferable onto said image receiver member in superimposed fashion.

39. An image forming apparatus according to claim 38, wherein a full-color image can be formed.

* * * * *

UNITED STATES PATENT AND TRADEMARK OFFICE

CERTIFICATE OF CORRECTION

PATENT NO. 5,294,959

DATED March 15, 1994

INVENTOR(S) NAGAO ET AL.

It is certified that error appears in the above-indentified patent and that said Letters Patent is hereby corrected as shown below:

Column 1

Line 51, "the," should read --the--.

Column 2

Line 21, "sheet," should read --sheet--.

Column 3

Line 56, "having," should read --having--.

Column 5

Line 18, "current," should read --current--.

Column 9

Line 18, "an" should read --as--.

UNITED STATES PATENT AND TRADEMARK OFFICE

CERTIFICATE OF CORRECTION

PATENT NO. : 5,294,959

DATED : March 15, 1994

INVENTOR(S) : Yoshinori Nagao, et al.

It is certified that error appears in the above-indentified patent and that said Letters Patent is hereby corrected as shown below:

Column 12, line 17, "control" should read--controls--.

Signed and Sealed this

First Day of November, 1994

*Attest:*

*Attesting Officer*

BRUCE LEHMAN

*Commissioner of Patents and Trademarks*